United States Patent [19]

Bahr

[11] 3,960,378

[45] June 1, 1976

[54] TARGET AND AIR ACTUATED PROJECTORS

[76] Inventor: William J. Bahr, 4101 Sandpiper Lane, Great Bend, Kans. 67530

[22] Filed: Mar. 12, 1975

[21] Appl. No.: 557,794

[52] U.S. Cl. ..... 273/85 H; 273/95 C
[51] Int. Cl.[2] ..... A63F 7/06
[58] Field of Search ..... 273/85 H, 118 R, 119 B, 273/95 C

[56] References Cited

UNITED STATES PATENTS

| | | | |
|---|---|---|---|
| 790,894 | 5/1905 | Henrichsen | 273/95 C |
| 1,776,196 | 9/1930 | Rochwarg | 273/95 C |
| 1,827,885 | 10/1931 | Emenhiser | 273/119 B |
| 3,574,350 | 4/1971 | May | 273/85 D |
| 3,711,097 | 1/1973 | Begley | 273/95 C |
| 3,771,789 | 11/1973 | Kammerl | 273/85 H |

*Primary Examiner*—Richard J. Apley
*Assistant Examiner*—Marvin Siskind
*Attorney, Agent, or Firm*—Sanford S. Wadler

[57] ABSTRACT

A game with a game board, the board being made of a mesh screen on which a lightweight game piece(s) is placed. Mounted in parallel and spanning the width of the mesh screen from below are retractable, rotatable playing tubes. Each playing tube is capped at one end, the other end being directly connected to an air bulb which also serves as a handle. Located on each playing tube is an angular nozzle(s) which can direct air flow from the tube through the mesh screen, causing the game piece(s) to move in the direction of the air flow. Goals and nets are provided so that games such as basketball, volleyball, soccer, tennis and the like may be simulated on the game board.

4 Claims, 2 Drawing Figures

TARGET AND AIR ACTUATED PROJECTORS

BACKGROUND OF THE INVENTION

Previously, games have been known in which puffs of air have moved lightweight balls to simulate a basketball game. In this connection, reference is made to Schreiber et al, U.S. Pat. No. 943,472 and Owens, U.S. Pat. No. 1,756,299. Unfortunately, these games provide for only a very limited number of playing positions, greatly restricting the manner in which the players can try their skill.

The present invention provides a wide range of opportunities in which the player or players can use and further develop their dexterity. Although the present invention may be played with only one player, optimum interest and skill is exhibited if two or more players take part to act as opponents and/or teammates. The present invention also allows the participants to play over the entire game field and to move the game piece to and from any position on the field. In the process, they can also pass the game piece from player to player, so as to more closely simulate an actual game of basketball, volleyball, soccer, tennis, or the like.

SUMMARY OF THE INVENTION

Generally, the present invention comprises a game board made of a rigid material having a multiplicity of air spaces. By way of example only and not by way of limitation, materials such as wire mesh and fiberglass screen are suitable for use in the construction of the playing field. At various points on, above, or across the field, goals or nets can be positioned. The choice of goals or nets and their positioning depends upon whichever game the players desire to simulate.

Beneath the mesh screen are mounted a multiplicity of rotatable and retractable playing tubes, each attached to an air bulb to enable the player to direct air upward at any angle by positioning the tube's nozzles in the desired direction and compressing the air bulb. The resultant air flow is thus used to propel the game piece towards a goal or across a net.

It is an object of the present invention to provide a multiplicity of rotatable and retractable mounted playing tubes which direct air flow in any desired direction at the game piece when an air bulb is compressed.

It is a further object of this game to provide a novel game which allows one or more players to simulate the excitement and competition of such skill sports as basketball, volleyball, soccer, tennis, or the like.

It is a still further object of the present invention to provide an interesting and amusing game which can be played in a small area such as a table top and stored easily when not in use.

Still further objects will become apparent from the detailed description that follows when taken in combination with the accompanying drawing.

DESCRIPTION OF THE PREFERRED EMBODIMENTS

Figure 1:
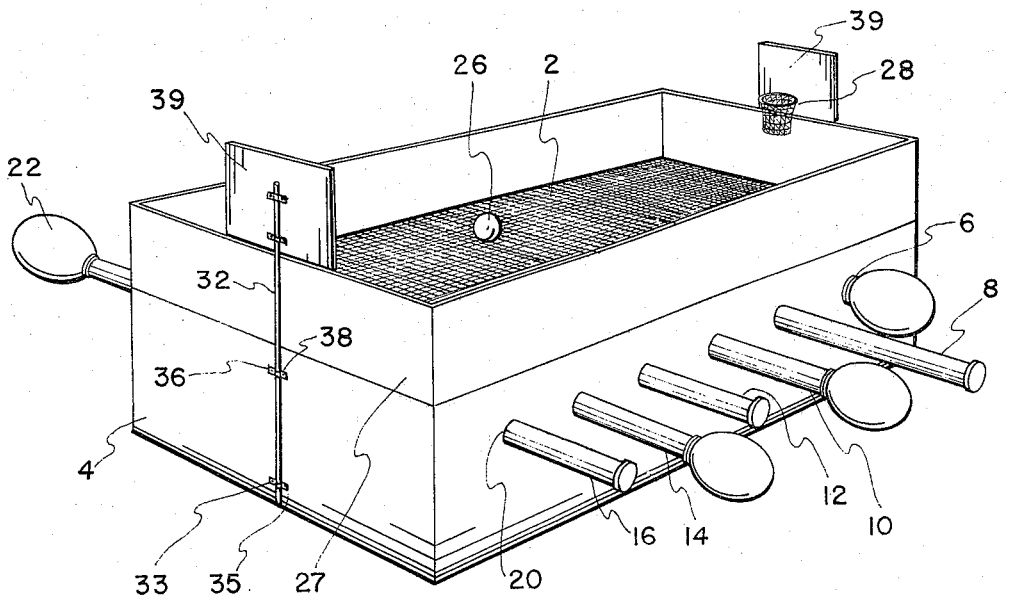
FIG. 1 is a perspective view showing one form of game apparatus constructed according to and embodying the present invention.
Figure 2:
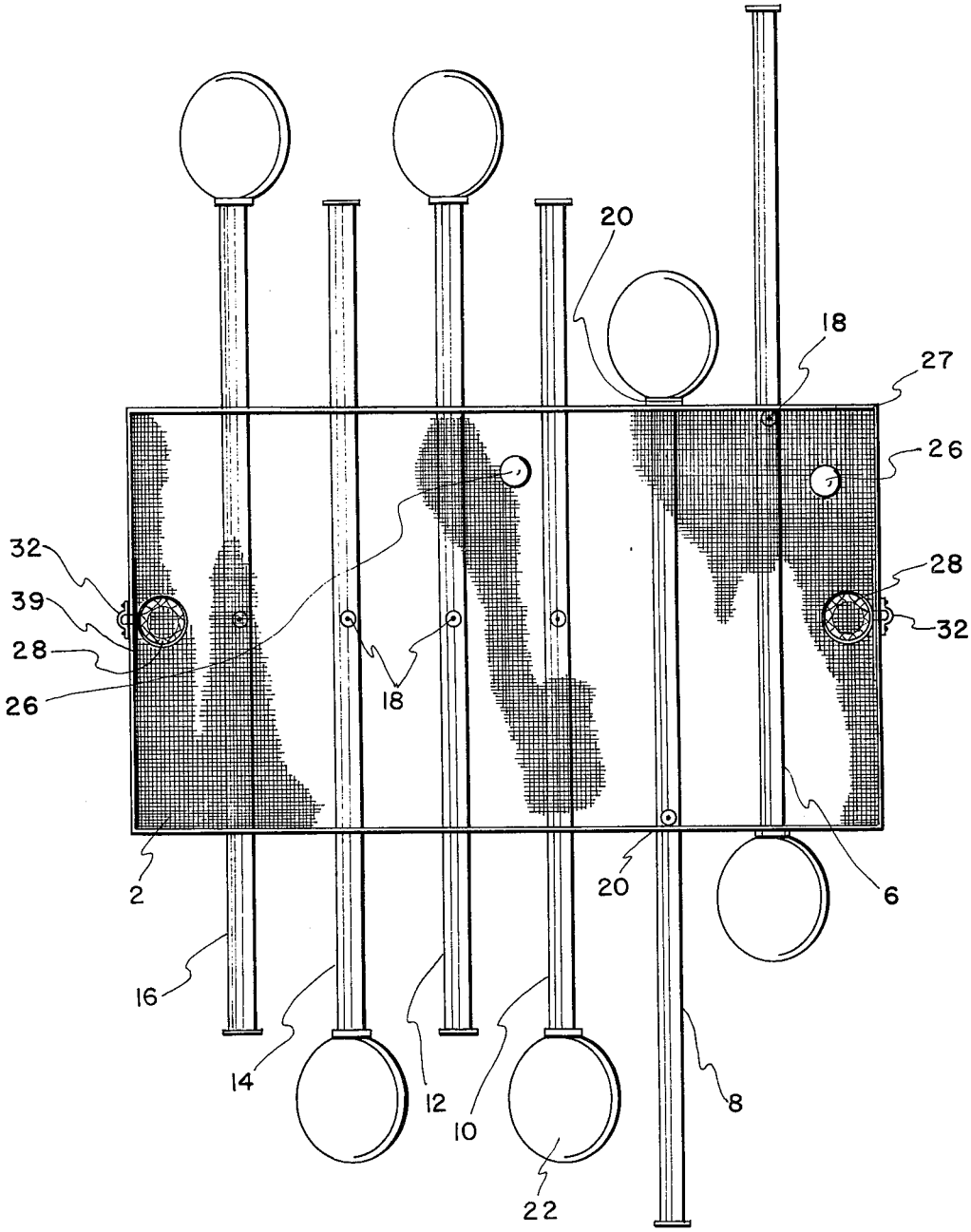
FIG. 2 is top plan view of the game apparatus illustrated in FIG. 1.

Referring to FIGS. 1 and 2, an airball game is illustrated having a mesh screen 2, a base 4 made of wood, metal, plastic, or the like, and six playing tubes 6–16 made of wood, metal, plastic, or other rigid material. Each playing tube is a device which is substantially tubular in shape, having an angular nozzle 18 at some point(s) on the tubular body for ingress and egress of air. Each playing tube possesses a hollow bulbshaped handle referred to herein as an air bulb made of a readily deformable yet resilient material such as rubber. The playing tubes are mounted in circular slots 20 and may be rotated as well as moved back and forth throughout the width of the playing field. When an air bulb handle 22 is compressed, a blast of air issues from the nozzle 18 and propels a game piece 26 made of a lightweight material such as plastic. A border wall 27 removeably mounted upon the perimeter of the mesh screen 2 serves to prevent the game piece(s) from leaving the playing area which is defined by mesh screen 2 and border wall 27. Goals are positioned on the playing field depending on the game to be played.

If basketball is to be played, the game further provides for a basket 28 fitted with a backing member 39 to be placed at each end of the border wall 27, each basket being suspended from a horizontally disposed hoop 30 which is supported by a rigid wire 32 attached by a removable clamp 34 directly to the base structure. The clamp 34 is affixed to the base by two screws 36 and 38. A second clamp may be provided which is identical to clamp 34 and affixed by screws 36 and 38. The second clamp aids in stabilizing the position of the rigid wire 32. Both clamps may be easily removed when the basket goal is not in use. If soccer is to be played, shaped goals (not shown) made of a combination of metal, plastic, netting, or similar material may be placed directly on the game board. If tennis or volleyball is to be played, nets (not shown) made of metal, plastic, cord, or combination thereof may be placed directly on the game board.

In playing the illustrated basketball game, one of the players places the game piece in the center of the mesh screen. The players then move their playing tubes back and forth and at various angles, attempting by compressing the air bulb handle 22 to propel the game piece 26 into the basketball net 28 of the opponent (or into a goal if soccer is being played or across a net if volleyball is being play). The players may also use air flows to block the shots of their opponents. Action such as this closely simulates the action which takes place in an actual basketball, soccer, or volleyball game.

The exact rules of the game may be formulated by the players themselves before the game begins; this will add to the interest of the game and permit variations as desired by the players who may vary in number from one to a large group such as six. What has been shown and described is only a preferred embodiment of the present invention, and it should be understood that the terms employed are terms of description and not of limitation; and it is recognized that minor changes in the size, shape, and arrangement of parts may be resorted to within the scope of the invention claimed.

What is claimed is:

1. An airball game comprising: a game piece; a base; a mesh screen removeably mounted on said base allowing passage of air through its mesh, a border wall removeably mounted around said screen; a plurality of playing tubes retractably and rotatably mounted in the base to underlie the screen and extending the entire transverse length of the base; said tubes having an air bulb on one end and a cap at the second end; a nozzle spaced intermediate the ends of the tubes; and at least one goal positioned within the playing area defined by the screen and the border wall whereby the game piece is moved toward the goal in the direction of air flow through the nozzle when the air bulbs are squeezed and the tubes manipulated.

2. A game as claimed in claim 1 wherein said goal comprises a horizontal disc having a net attached thereto and supported by a rigid wire removeably clamped to said base.

3. A game as claimed in claim 1 wherein said goal comprises a net placed on said screen.

4. A game as claimed in claim 1 wherein said goal comprises said screen as divided by a net positioned across the width of said screen.

* * * * *